US008407966B2

(12) United States Patent
Strickland et al.

(10) Patent No.: US 8,407,966 B2
(45) Date of Patent: Apr. 2, 2013

(54) COLD-FORMED STEEL JOIST

(75) Inventors: Michael R. Strickland, Richmond Hill (CA); Douglas M. Fox, Kitchener (CA); Lei Xu, Waterloo (CA)

(73) Assignee: iSpan Systems LP, Princeton, ON (CA)

( * ) Notice: Subject to any disclaimer, the term of this patent is extended or adjusted under 35 U.S.C. 154(b) by 453 days.

(21) Appl. No.: 12/585,402

(22) Filed: Sep. 14, 2009

(65) Prior Publication Data

US 2010/0139201 A1 Jun. 10, 2010

Related U.S. Application Data

(63) Continuation-in-part of application No. 10/974,964, filed on Oct. 28, 2004, now Pat. No. 7,587,877, which is a continuation-in-part of application No. 10/721,610, filed on Nov. 25, 2003, now abandoned.

(60) Provisional application No. 60/514,622, filed on Oct. 28, 2003.

(51) Int. Cl.
*E04C 3/00* (2006.01)
*E04H 12/00* (2006.01)

(52) U.S. Cl. ..... 52/837; 52/650.1; 52/838; 52/846

(58) Field of Classification Search ..... 52/837, 52/838, 846, 289, 407.3, 650.1
See application file for complete search history.

(56) References Cited

U.S. PATENT DOCUMENTS

| | | | | |
|---|---|---|---|---|
| 827,268 | A | 7/1906 | Stieper | |
| 1,360,720 | A | 11/1920 | Brown et al. | |
| 1,622,559 | A | 3/1927 | Zabriskie | |
| 1,663,487 | A * | 3/1928 | Smith et al. | 52/695 |
| 1,737,601 | A * | 12/1929 | Macomber | 52/376 |
| 1,915,424 | A | 6/1933 | Kerr | |
| 1,918,345 | A | 7/1933 | McHose | |
| 1,974,730 | A | 9/1934 | Zollinger | |
| 1,983,632 | A | 12/1934 | Miller | |
| 2,088,781 | A | 8/1937 | Folsom | |
| 2,108,373 | A | 2/1938 | Greulich | |
| 2,169,253 | A * | 8/1939 | Kotrbaty | 52/693 |

(Continued)

FOREIGN PATENT DOCUMENTS

| | | |
|---|---|---|
| AU | 47479/79 | 12/1980 |
| AU | 540590 | 1/1985 |

(Continued)

OTHER PUBLICATIONS

International Search Report (PCT/CA2010/001405) filed Sep. 14, 2010, completed (Jan. 13, 2011).

(Continued)

*Primary Examiner* — Andrew Triggs
(74) *Attorney, Agent, or Firm* — Hill & Schumacher

(57) ABSTRACT

An upper chord bearing joist comprising a top chord member and a bottom chord member, each having a flange portion and a web receiving portion including two web receiving tabs, each made from a unitary piece of metal; a generally planar steel web, a portion of the web being attached to the top chord member and to the bottom chord member, wherein a top portion of the web is between the two web receiving tabs of the top chord member and a bottom portion of the web is between the two web receiving tabs of the bottom chord member; and a first and second pair of support members, each support member including a shoe portion, a web attaching portion, and an angled portion, the web attaching portion being attached to the web receiving tabs and the angled portion being in contact with the web. The joist may be cambered, have reinforcement stiffeners, and have a rotatable joint at either end. The joists may be used in composite with concrete or with wood.

17 Claims, 16 Drawing Sheets

U.S. PATENT DOCUMENTS 2,194,810 A 3/1940 Reiner
2,246,215 A 6/1941 Nagin et al.
2,256,812 A 9/1941 Miller
2,457,250 A 12/1948 Macomber
2,514,607 A 7/1950 McLean
2,624,430 A 1/1953 Macomber
2,630,890 A 3/1953 Macomber
2,630,899 A 3/1953 Macomber
2,662,272 A 12/1953 Macomber
2,860,743 A 11/1958 Cliff
2,864,471 A 12/1958 Williams
3,158,731 A 11/1964 Cape
3,221,467 A 12/1965 Henkels
3,288,977 A 11/1966 Keller
3,349,535 A 10/1967 Balinski
3,367,080 A 2/1968 McClelland
3,381,439 A 5/1968 Thulin, Jr.
3,483,665 A 12/1969 Miller
3,487,861 A 1/1970 Fahrenbach
3,626,567 A 12/1971 Michelson et al.
3,639,962 A 2/1972 Gooder
3,641,303 A 2/1972 Collins
3,818,083 A 6/1974 Butts et al.
3,942,297 A 3/1976 Kitagawa
3,945,168 A 3/1976 Butts et al.
3,945,741 A 3/1976 Wendt
3,979,868 A 9/1976 Butts et al.
4,041,664 A 8/1977 Davis, Jr.
4,056,908 A 11/1977 McManus
4,122,647 A 10/1978 Kovar
4,151,694 A 5/1979 Sriberg et al.
4,159,604 A 7/1979 Burrell
4,189,883 A 2/1980 McManus
4,207,719 A 6/1980 Knowles
4,281,497 A 8/1981 Luotonen et al.
4,385,476 A 5/1983 Slager
4,409,771 A 10/1983 Lowe
4,421,969 A 12/1983 Tanenbaum
4,432,178 A 2/1984 Taft
4,441,292 A 4/1984 Ericsson
4,454,695 A 6/1984 Person
4,476,662 A 10/1984 Fisher
4,490,958 A 1/1985 Lowe
4,548,014 A 10/1985 Knowles
4,549,381 A 10/1985 Holtz
4,560,301 A 12/1985 Gilb
4,566,240 A 1/1986 Schilger
4,569,177 A 2/1986 Ottinger
4,592,184 A 6/1986 Person et al.
4,688,358 A 8/1987 Madray
4,691,494 A 9/1987 Gwynne
4,702,059 A 10/1987 Holtz
4,715,155 A 12/1987 Holtz
4,720,957 A 1/1988 Madray
4,729,201 A 3/1988 Laurus et al.
4,741,138 A 5/1988 Rongoe, Jr.
4,793,113 A 12/1988 Bodnar
4,836,436 A 6/1989 Hannah
4,837,994 A 6/1989 Stohs
4,845,908 A 7/1989 Stohs
4,887,406 A 12/1989 Saia
4,937,997 A 7/1990 Thomas, Jr. et al.
4,937,998 A 7/1990 Goldberg
4,947,612 A 8/1990 Taylor et al.
4,982,545 A 1/1991 Stromback
4,986,051 A 1/1991 Meyer et al.
5,004,369 A 4/1991 Young
5,146,726 A 9/1992 Ellison, Jr.
5,207,045 A 5/1993 Bodnar
5,214,900 A 6/1993 Folkerts
5,220,761 A 6/1993 Selby
5,230,190 A 7/1993 Schuette
5,240,342 A 8/1993 Kresa, Jr.
5,279,093 A * 1/1994 Mead ..... 52/834
5,301,486 A 4/1994 Taylor
5,373,675 A 12/1994 Ellison, Jr.
5,417,028 A 5/1995 Meyer
5,476,704 A 12/1995 Kohler
5,499,480 A 3/1996 Bass
5,527,625 A 6/1996 Bodnar
5,544,464 A 8/1996 Dutil
5,546,716 A 8/1996 Broxterman et al.
5,553,437 A 9/1996 Navon
5,560,177 A * 10/1996 Brightwell ..... 52/841
5,625,995 A 5/1997 Martin
5,669,197 A 9/1997 Bodnar
5,687,538 A 11/1997 Frobosilo et al.
5,761,873 A 6/1998 Slater
5,771,653 A 6/1998 Dolati et al.
5,842,318 A 12/1998 Bass et al.
5,865,008 A 2/1999 Larson
5,875,605 A 3/1999 Rudd
5,895,534 A 4/1999 Daley et al.
5,927,036 A 7/1999 Matthews et al.
5,937,608 A 8/1999 Kucirka
5,941,035 A 8/1999 Purse
6,073,414 A 6/2000 Garris et al.
6,131,362 A 10/2000 Buecker
6,167,675 B1 * 1/2001 LeBlanc ..... 52/847
6,170,217 B1 1/2001 Meyer
6,254,306 B1 7/2001 Williams
6,263,634 B1 7/2001 Bodnar et al.
6,301,854 B1 10/2001 Daudet et al.
6,301,857 B1 10/2001 Vrana
6,415,577 B1 7/2002 Curtis
6,418,694 B1 7/2002 Daudet et al.
6,436,552 B1 8/2002 Walker et al.
6,457,292 B1 10/2002 Vrana
6,484,464 B1 11/2002 Ochoa
6,519,908 B1 2/2003 Masterson et al.
6,571,527 B1 6/2003 Rattini
6,634,153 B1 10/2003 Peterson
6,658,809 B2 12/2003 Collins
6,662,517 B1 12/2003 Thompson
6,708,459 B2 3/2004 Bodnar
6,761,005 B1 7/2004 Daudet et al.
6,799,406 B2 10/2004 Gosselin et al.
6,799,407 B2 10/2004 Saldana
6,843,036 B2 1/2005 Stewart, III
6,874,294 B2 4/2005 Masterson et al.
6,964,140 B2 11/2005 Walker et al.
7,086,208 B2 8/2006 Masterson et al.
7,093,401 B2 8/2006 Collins
7,107,730 B2 * 9/2006 Park ..... 52/223.8
7,231,746 B2 6/2007 Bodnar
7,240,463 B2 7/2007 Masterson et al.
7,409,804 B2 8/2008 Moody et al.
7,546,714 B2 6/2009 Masterson et al.
2002/0020138 A1 2/2002 Walker et al.
2002/0029538 A1 3/2002 Webb
2002/0046534 A1 4/2002 Heinly
2002/0069606 A1 6/2002 Gosselin et al.
2002/0144484 A1 10/2002 Vrana
2003/0014934 A1 1/2003 Bodnar
2003/0014935 A1 1/2003 Bodnar
2003/0061780 A1 4/2003 Masterson
2003/0084637 A1 5/2003 Daudet
2005/0102962 A1 5/2005 McInerney et al.
2005/0144892 A1 7/2005 Strickland et al.
2010/0139201 A1 * 6/2010 Strickland et al. ..... 52/634

FOREIGN PATENT DOCUMENTS

AU 543398 1/1985
AU 14733/97 2/1997
AU 199952660 10/1999
AU 762835 7/2003
AU 2004100666 8/2004
CA 900687 5/1972
CA 1172463 8/1984
CA 2092809 11/2001
CA 2412726 11/2009
CA 2455071 11/2011
GB 668485 3/1952
GB 1447055 8/1976
GB 2340141 2/2000
JP 8338103 12/1996

| | | |
|---|---|---|
| WO | 02/01016 | 1/2002 |
| WO | 03/057931 | 7/2003 |
| WO | 2005/042869 | 5/2005 |

OTHER PUBLICATIONS

International Search Report for PCT/CA2010/001750, mailed Feb. 21, 2011.

Ortech Industries Pty Ltd., Easibeams Steel Sections [pamphlet] (no date).

International Search Report for PCT/CA2010/001405, mailed Jan. 27, 2011.

* cited by examiner

COLD-FORMED STEEL JOIST

CROSS REFERENCE TO RELATED PATENT APPLICATION

This patent application relates to U.S. Provisional Patent Application Ser. No. 60/514,622 filed on Oct. 28, 2003 entitled SINGLE WEB COLD FORMED JOIST; U.S. patent application Ser. No. 10/721,610 filed on Nov. 25, 2003 entitled SEGMENTED COLD FORMED JOIST; and U.S. patent application Ser. No. 10/974,964 filed on Oct. 28, 2004 entitled COLD-FORMED STEEL JOIST each of which is incorporated herein by reference in its entirety.

FIELD OF THE INVENTION

This invention relates to cold-formed steel joists and to assemblies of such joists to provide structural support for floors and roofs in the building construction industry.

BACKGROUND OF THE INVENTION

For industrial and commercial applications the preferred roof and floor joist is a top chord bearing joist. In North America the top chord bearing joist market is predominantly serviced by the open web steel joist (OWSJ) market that is regulated by the Steel Joist Institute (SJI). The top chord joist provides an excellent method for erection when a crane is used, as top chord bearing joists passively stay in place by gravity. A problem with the present art is that the designs require an abundance of parts and considerable man hours to produce. The OWSJ is difficult to customize for the many alternative conditions that arise on construction projects today. Present top chord bearing joists as described in the SJI specifications are typically built using hot rolled steel shapes; however, some OWSJ designs have elements that are cold rolled shapes. There are top chord bearing joists using special cold formed shapes that are arranged in a manner similar to the OWSJ, so these proprietary OWSJ projects also have abundant parts and require abundant man hours to produce. The top chord bearing joists specified in SJI and the special shaped joists both require approximately 6 to 10 man hours per ton to manufacture and require additional man hours to customize.

Typical standard joists as identified in the Steel Joist Institute (SJI) specifications have top and bottom chords that are angle sections and the webs are round bars or cold formed U shapes or crimped angles; shoes for end bearing are fixed to the top chords at the ends, typically by welding. These joists are customized to suit the conditions of each project. When OWSJ's are used for sloping conditions, the shoes are typically drawn by a draftsman, arranged to fit the desired angle by a fitter in the shop and then welded. Installing sloped shoes can be very expensive. Concentrated loads often require the need of engineering to satisfy special loading conditions. On a 40 ft long joist there will be approximately 44 pieces. Many pieces are different sizes and weights; the pieces are custom cut on a saw line for each project. In today's industry joists are produced with a high factor of labour cost, from 6 to 10 man hours a ton depending on location, support infrastructure, plant capabilities and product mix.

Some cold formed joist systems are available on the market that have very similar assembly methods to that of the OWSJ. The available systems often have special shaped chords and web members. A cold formed top chord bearing joist system maintains a high quantity of parts utilization and associated man hours to assemble. Most of the available cold formed joist systems are difficult to customize similar to the OWSJ products described in SJI.

FIG. 1 and FIG. 2 shows prior art open web steel joists. FIG. 2 is a sketch of an alternate cold formed top chord bearing joist as described in U.S. Pat. No. 6,519,908 filed 27 Jun. 2000 and titled "Structural member for use in the construction of buildings".

In the past many innovative steel joist designs have been developed and introduced to the market. The market is demanding in terms of performance requirements to suit alternative building design types, therefore these products require significant customization for each project. The present art of OWSJ designs, such as those shown in FIG. 1 and FIG. 2, are difficult to adapt to the alternative project conditions and design protocols. Customizing alternative joist designs to suit different conditions can be expensive. A top chord bearing joist that can be manufactured with the fewest number of pieces and require the smallest amount of physical modification, yet suit all of the alternative conditions would be highly desirable.

Therefore, a new and improved way to provide top chord bearing joists would be to provide a joist that reduces labour hours, reduces material use and is easy to customize for the many alternative project conditions.

SUMMARY OF THE INVENTION

Embodiments of the present invention have been developed to facilitate the customization of top chord bearing joists to suit the many conditions that exist in the top chord joist market, using a minimal number of parts and person hours. The cold-formed steel joist as described herein satisfies all of the given alternatives for the application of top chord bearing joists and provides enhanced use of materials and facilitates superior advanced manufacturing methods. The end result is superior structural top chord bearing joist components at a lower cost. FIG. 3 and FIG. 4 compare prior art open webs teel joists (OWSJ) with the preferred embodiment of the present invention, the concentric cold-formed joist (CCFJ).

The top chord bearing joist as described herein improves material use, reduces waste, reduces man hours to manufacture and increases daily output of product. Construction of the joist makes use of cold formed shapes that are not necessarily limited to single functions, thereby satisfying shifting needs of the market.

An embodiment of the present invention relates to an upper chord bearing joist comprising: a top chord member and a bottom chord member, each having a flange portion and a web receiving portion including two web receiving tabs, each made from a unitary piece of metal; a generally planar steel web, a portion of the web being attached to the top chord member and to the bottom chord member, wherein a top portion of the web is between the two web receiving tabs of the top chord member and a bottom portion of the web is between the two web receiving tabs of the bottom chord member; and a first and second pair of support members, each support member including a shoe portion, a web attaching portion, and an angled portion, the web attaching portion being attached to the web receiving tabs and the angled portion being in contact with the web.

Another embodiment of the present invention relates to an upper chord bearing joist comprising: a top chord member being cold-formed from a unitary piece of sheet steel and having: a flange portion, a web receiving portion including two web receiving tabs, and a pair of integral inner flange portions, each inner flange portion extending substantially perpendicularly from one of the web receiving tabs so as to be in a spaced relationship to the flange portion, each top chord member being cold-formed from a unitary piece of sheet metal; a bottom chord member being cold-formed from a unitary piece of sheet steel and having a flange portion and a web receiving portion including two web receiving tabs; and a generally planar steel web, a portion of the web being attached to the the top chord member and to the bottom chord member, wherein a top portion of the web is between the two web receiving tabs of the top chord member and a bottom portion of the web is between the two web receiving tabs of the bottom chord member, said top portion defining a top surface area of contact, and said bottom portion defining a bottom surface area of contact; wherein each chord member is cambered about the web such that the top and bottom surface area of contact varies along a length of the joist.

Another embodiment of the present invention relates to an upper chord bearing joist comprising: a top chord member and a bottom chord member, each having a flange portion and a web receiving portion including two web receiving tabs, each made from a unitary piece of metal; a generally planar steel web, a portion of the web being attached to the top chord member and to the bottom chord member, wherein a top portion of the web is between the two web receiving tabs of the top chord member and a bottom portion of the web is between the two web receiving tabs of the bottom chord member; and a first and second pair of support members, each support member including a shoe portion, a web attaching portion, and an angled portion, the web attaching portion being attached to the web receiving tabs and the angled portion being in contact with the web; wherein each chord member is cambered about the web such that the surface area of contact varies along a length of the joist.

Another embodiment of the present invention relates to an upper chord bearing joist comprising: a top chord member and a bottom chord member, each having a flange portion and a web receiving portion including two web receiving tabs, each made from a unitary piece of metal; a generally planar steel web, a portion of the web being attached to the top chord member and to the bottom chord member, wherein a top portion of the web is between the two web receiving tabs of the top chord member and a bottom portion of the web is between the two web receiving tabs of the bottom chord member; and wherein the generally planar steel web includes a plurality of web segments which in combination define a generally planar steel web.

A further understanding of the functional and advantageous aspects of the present invention can be realized by reference to the following detailed description and drawings.

BRIEF DESCRIPTION OF THE DRAWING

Preferred embodiments of the invention will now be described, by way of example only, with reference to the drawings, in which.

DETAILED DESCRIPTION OF THE INVENTION

Without limitation, the majority of the systems described herein are directed to cold-formed steel joists. As required, embodiments of the present invention are disclosed herein. However, the disclosed embodiments are merely exemplary, and it should be understood that the invention may be embodied in many various and alternative forms.

The figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to cold-formed steel joists.

Figure 1:
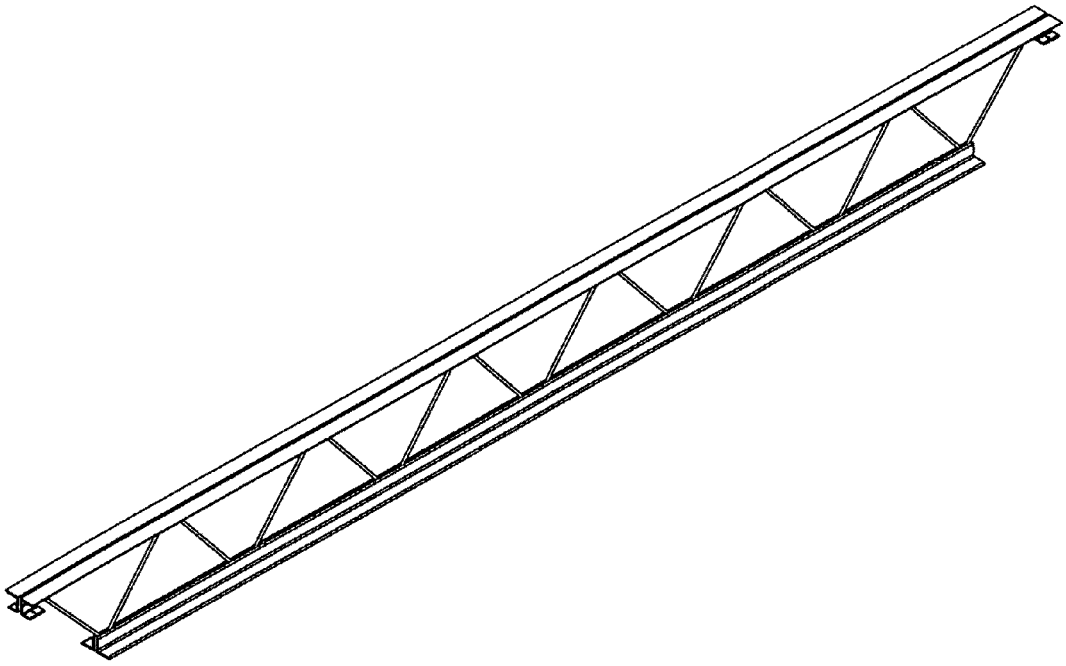
Figure 1 (PRIOR ART)
FIG. 1 shows a prior art open web steel joist.
Figure 2:
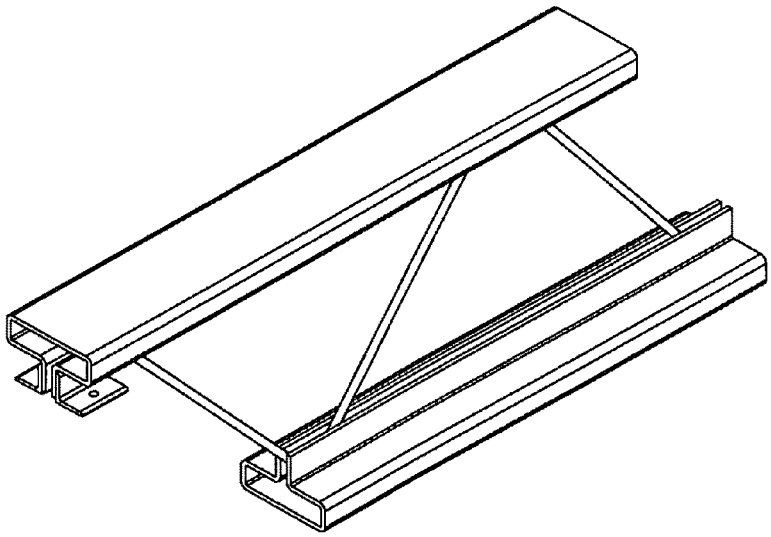
Figure 2 (PRIOR ART)
FIG. 2 shows a portion of a prior art open web steel joist with alternate top and bottom chords.
Figure 3:
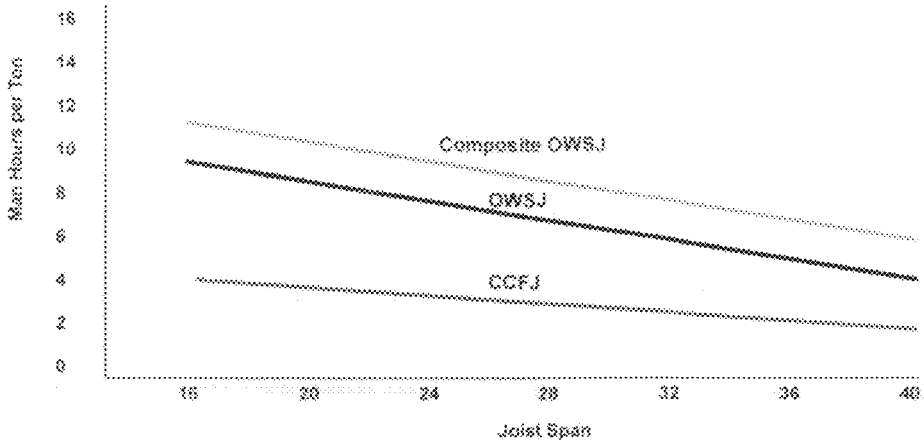
FIG. 3 shows a chart comparing man hours per ton between prior art joists and the preferred embodiment of the present invention.
Figure 4:
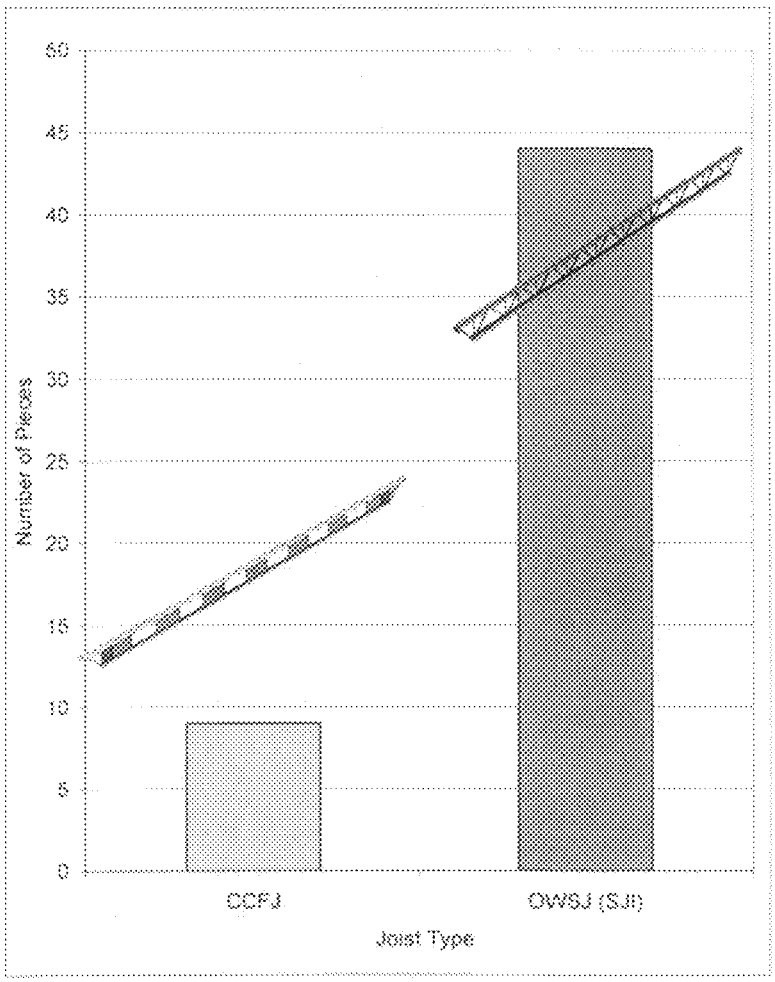
FIG. 4 shows a chart comparing number of pieces between prior art joists and the preferred embodiment of the present invention.
Figure 5:
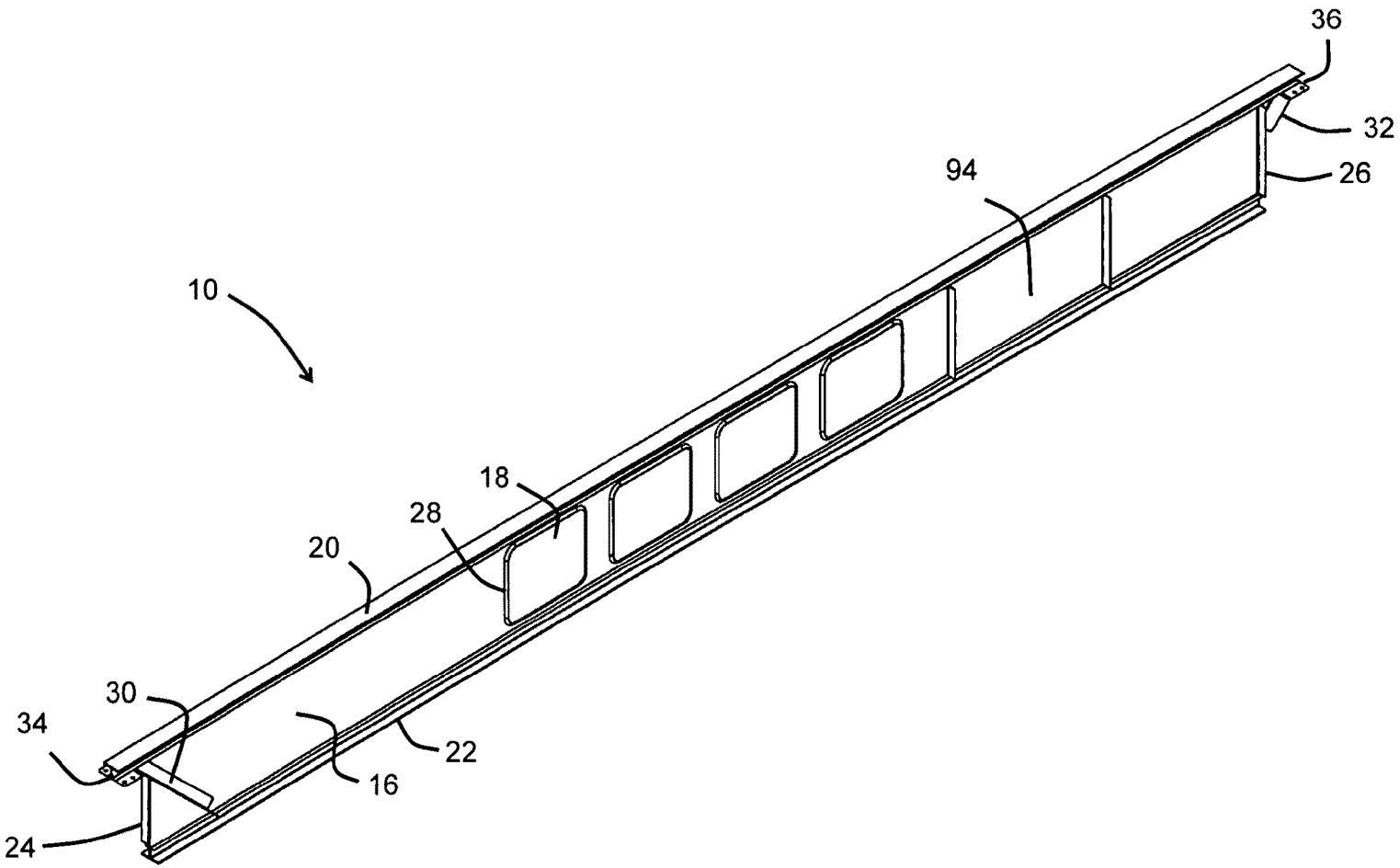
FIG. 5 shows an isometric view of a steel cold-formed joist.

FIG. 5 illustrates a top chord bearing cold-formed steel joist 10 having a top chord 20, a bottom chord 22, and a substantially planar steel web 16. The web 16 has a plurality of holes 18 that allow for other members to pass therethrough. The lips 28 strengthen against any stress concentrations introduced by the holes 18.

The top chord bearing joist 10 has a diagonal member 30 and diagonal member 23 at each ends which may simultaneously function as joist bearing shoes 34 and 36 in conjunction with the top chord of the joist. The planar steel web 16 provides the ability to customize the joist 10 with stiffener components to suit special design loads. As discussed below, additional members may be affixed to the web or chords to increase the load capacity of the joist 10.

Figure 6:
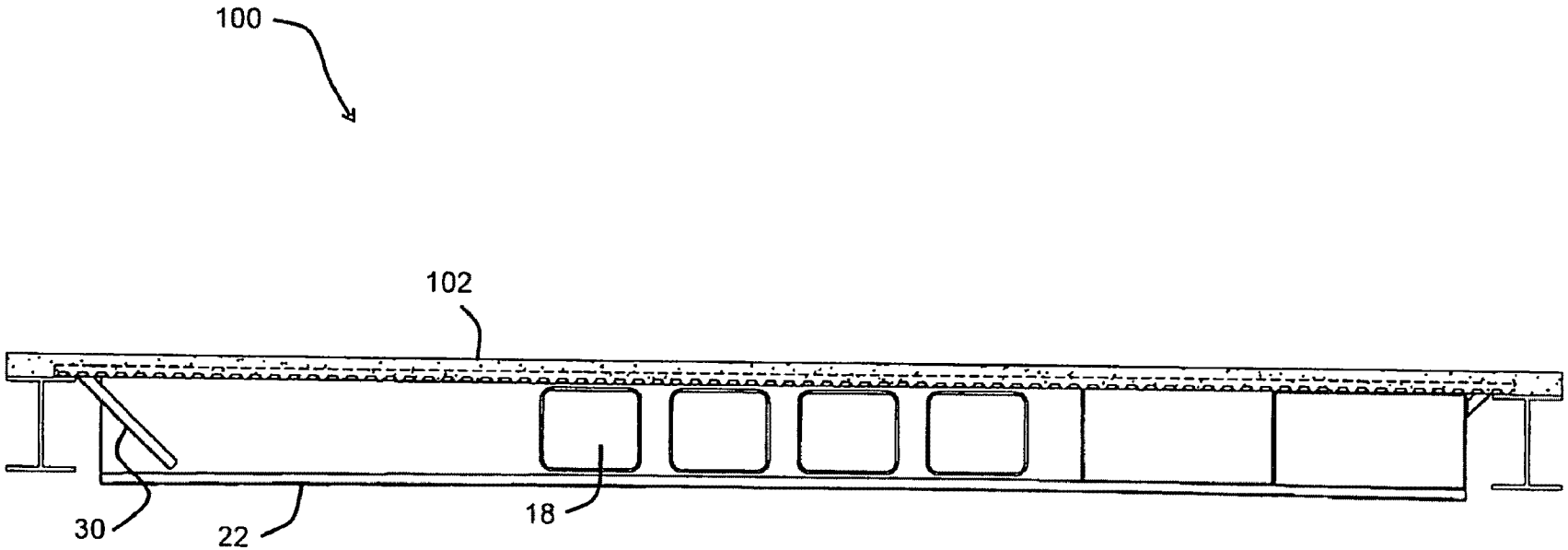
FIG. 6 shows a side view of a composite concrete steel cold-formed joist.

Referring to FIG. 6, it is a further aspect of the present invention to provide a composite concrete joist system 100 to be used in conjunction with a metal deck and wire mesh. The composite top chord bearing joist 100 provides a solution for providing concrete floors 102 on structural steel frames 108 and masonry walls (not shown).

Figure 7:
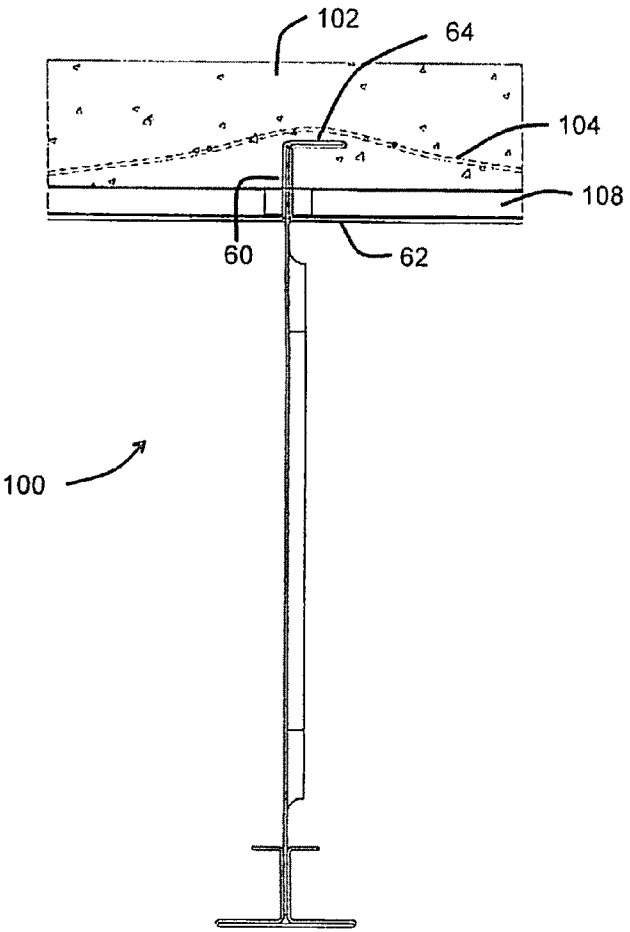
FIG. 7 shows a cross-section of the joist of FIG. 6

Generally speaking, for a structural joist member 100 to be composite, it must have means to mechanically interlock with the concrete 102 to provide sheer bonding. Accordingly, a steel deck 108 is adapted to rest on a top surface of the inner flange portions 62 as shown in FIG. 6 and FIG. 7. A wire mesh 104 may be added. Thereafter, concrete 102 may be poured onto the deck 108 so as to produce a floor or ceiling. A portion of the upper chord 20 is in contact with the concrete, thereby forming a concrete engaging portion. Web receiving portion 60 in combination with flange portion 64 may function as a concrete engaging portion. Since the flange portion 64 runs along the length of the top chord 20, possibility of snagging a worker's foot or clothing is minimized thereby adding to the safety feature of the joist prior to pouring of the concrete 102 over the deck 108.

The shear bond between the concrete engaging portion and the concrete may be increased by using rivets spot clinches or the like to increase the surface area of contact between the concrete and the top chord. Despite the asymmetry provided by the flange portion 64, this embodiment of the joist is substantially concentric since the concrete engaging portion is bonded to the concrete and the steel-concrete composite effectively distributes the applied load to each joist through its centre of gravity.

Interlock between the slab and the top chord of the joist provides the required shear bond capacity to allow composite action. The composite joist section acts as a 'T' beam, with the joist providing the required tensile resistance and the concrete substantially providing the compressive resistance.

Figure 8:
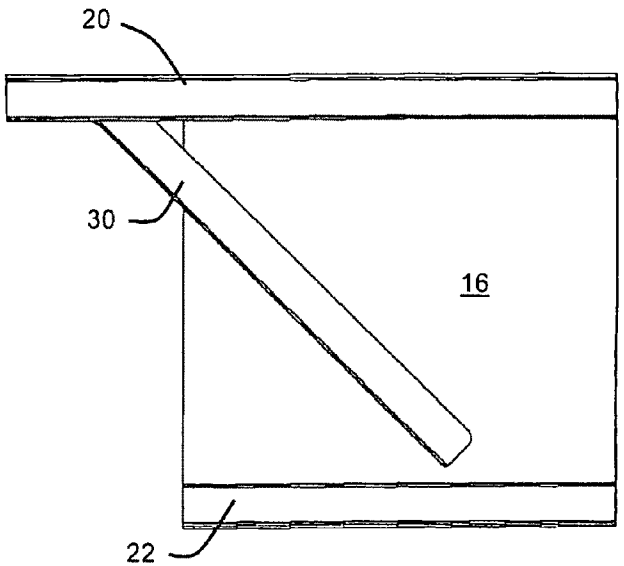
FIG. 8 is a side view of angled support members attachable to the joist.
Figure 9:
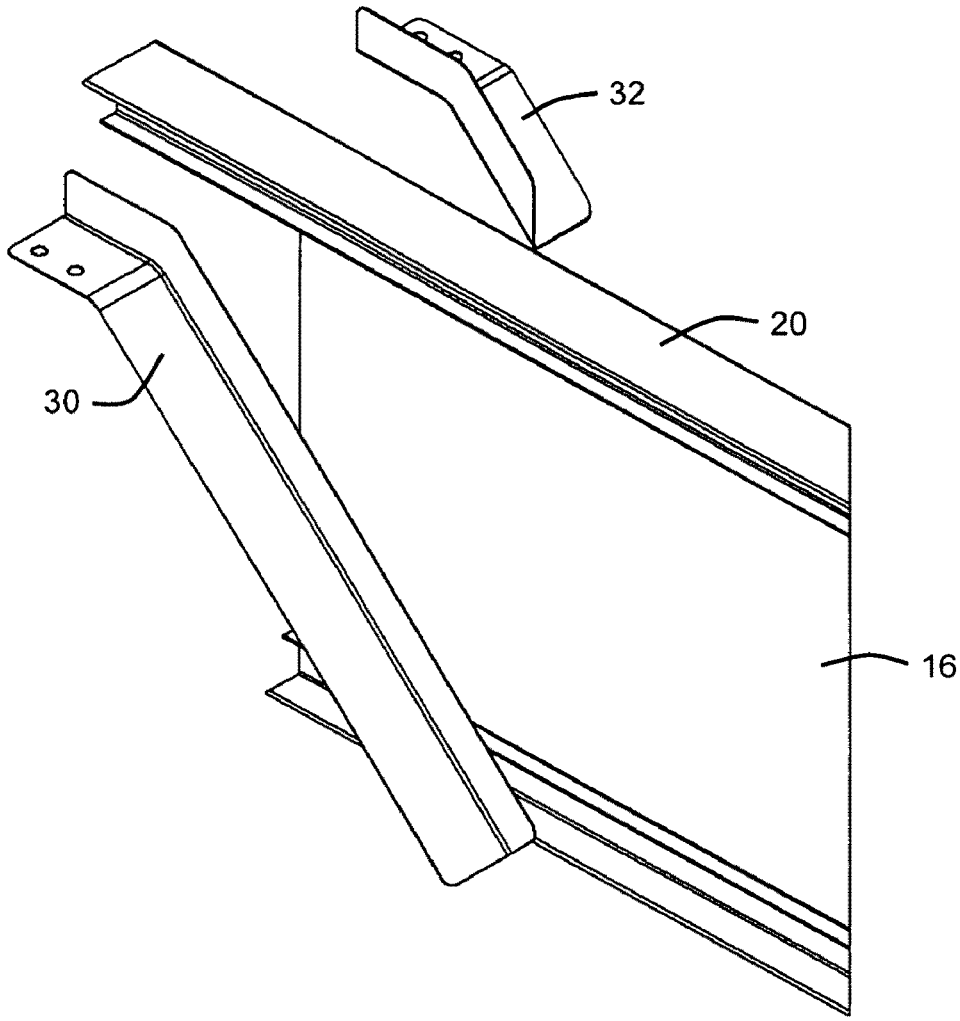
FIG. 9 shows a disassembly of angled support members.
Figure 10:
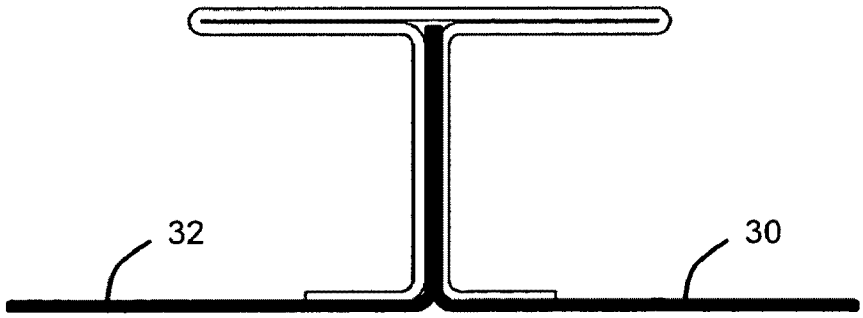
FIG. 10 shows a cross-section of one end of a steel cold-formed joist.
Figure 11:
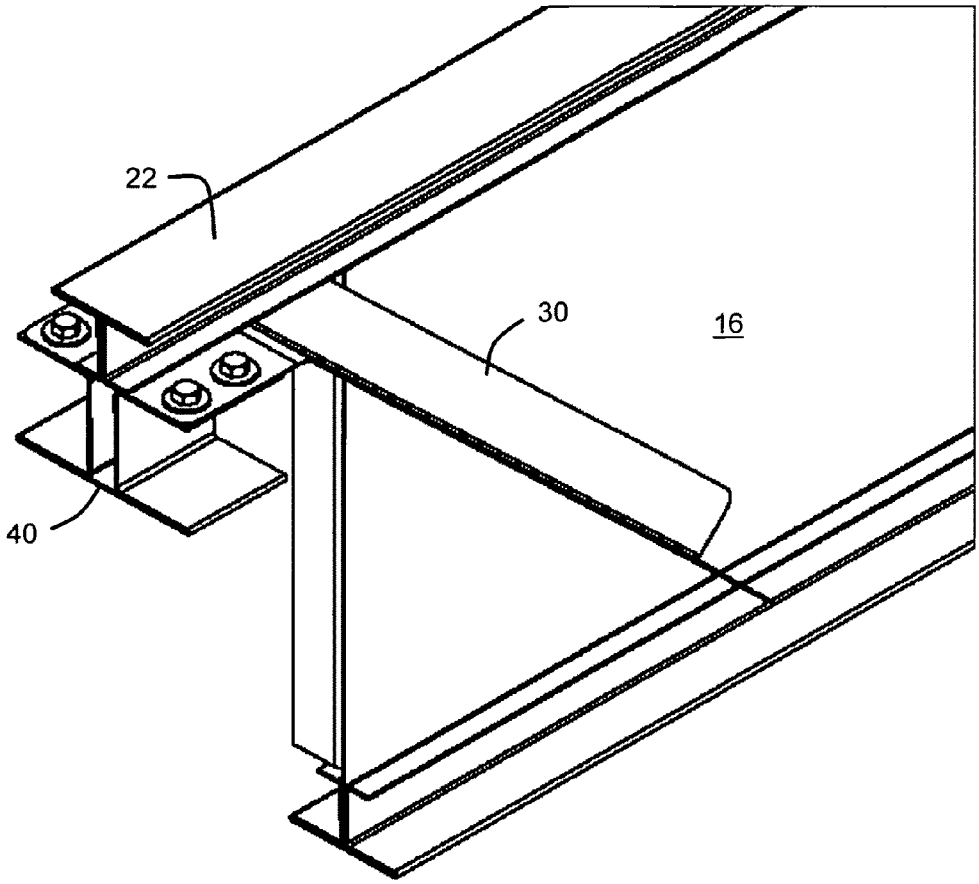
FIG. 11 shows an isometric view of one end of a steel cold-formed joist with a seat extension.
Figure 12:
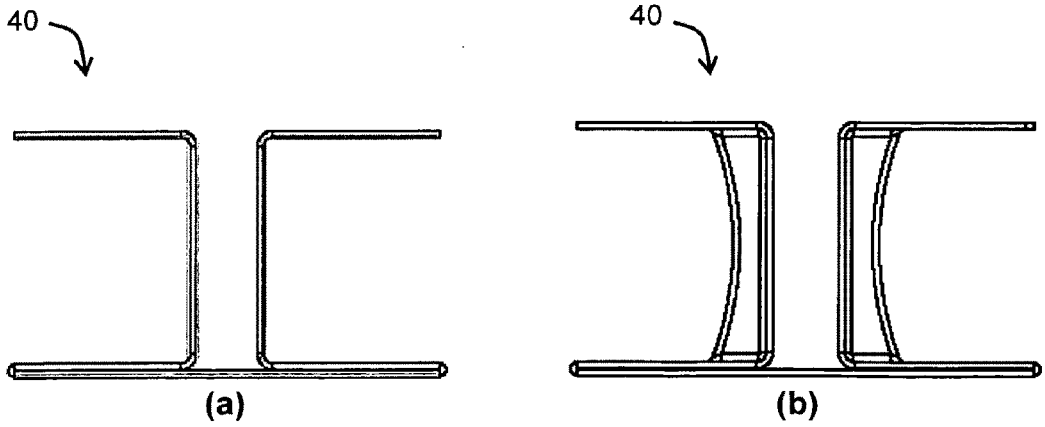
FIG. 12 shows cross-section views of possible seat extensions.

Referring to FIG. 8 and FIG. 9, diagonal member 30 and diagonal member 32 at each end of the joist 10 are shown in more detail. These members function as both stiffening members and as joist shoes, without requiring additional parts. They are cranked so that they may enter the upper chord 22 for fastening and so the outstanding leg of the angle may be fixed flat to the underside of the chord to function as a joist shoe. The chord depth and diagonal thickness may be designed to be total 2½" in depth to suit what is typically provided in the market. Joist seat extensions 40 may be added to suit any required shoe depth condition, as shown in FIG. 11. FIG. 12 shows two nonlimiting examples of joist seat embodiments (a) and (b). The seat extension 40 effectively raises the height of the joist and depends on the construction site requirements. The seat extension of FIG. 12(*a*) is made from a single piece of cold-formed sheet steel. The seat extension of FIG. 12(*b*) contains additional stiffening members to resist compressive stress.

Figure 13:
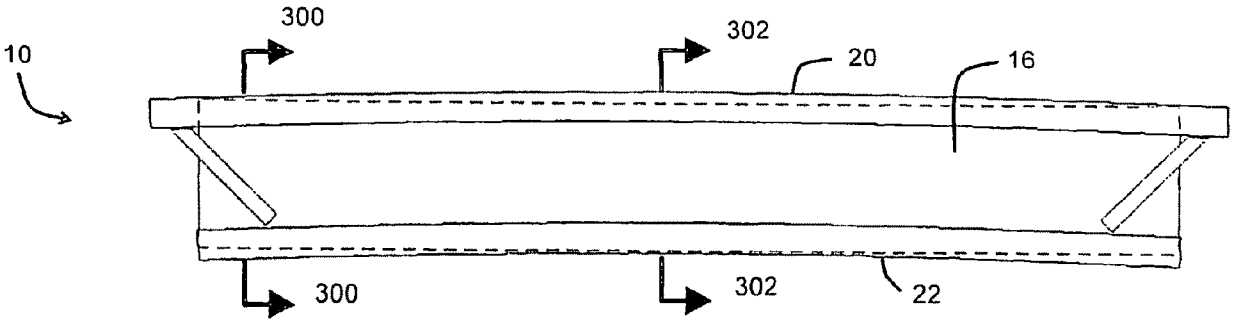
FIG. 13 shows a cambered joist with dotted-lines representing the web.
Figure 14:
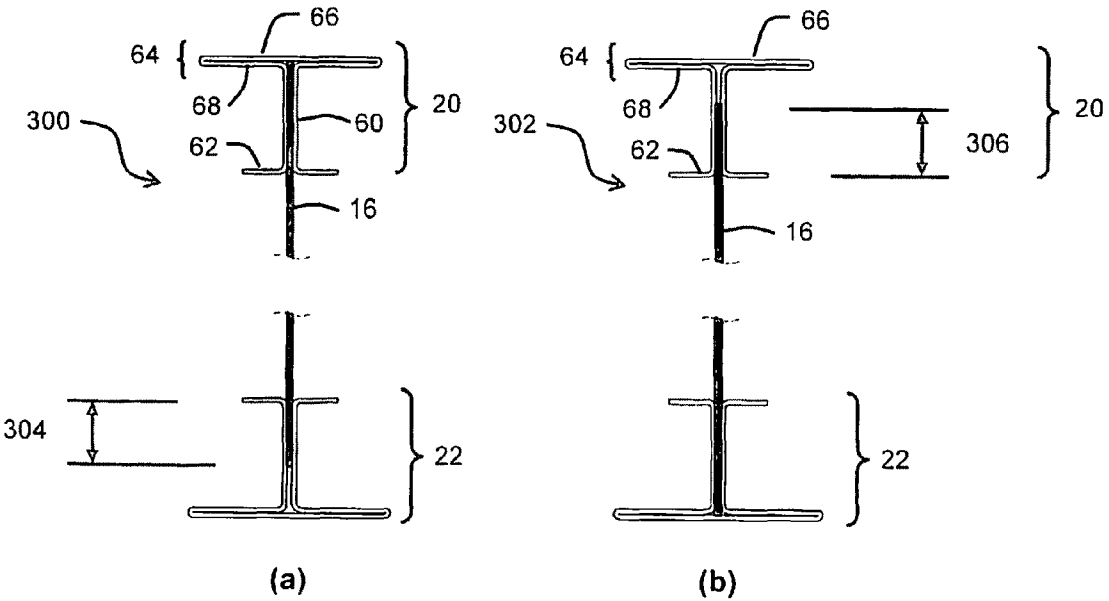
FIG. 14 shows two cross-sectional views of FIG. 13.

As shown in FIG. 13, the chords 20 and 22 of the present invention may be cambered with respect to the web 16 to account for dead load deflection. In construction, a straight sheet may be provided for the web 16 of the joist, while the chords 20 and 22 are curved and fastened to the web 16 to provide a desired joist camber. The chords 20 and 22 are sized to ensure that the minimum amount of fastening surface area is provided at any point along the web depending on the type of fastening method used. Non-limiting examples of fasteners methods include spot welds, fillet welds, and rivets. FIG. 14(*a*) and FIG. 14 (*b*) shows how the camber of chords 20 and 22 affects the surface area contact between the chords 20 and 22 and the web 16. Surface area 304 is larger near the center towards the centre of the joist than at the ends, while surface area 306 is larger near the ends compared to the center. It is desirable that the minimum surface area contact between the web 16 and chords 20 and 22 remain above a threshold value to ensure that the two may be fastened to one another.

FIG. 14(*a*) illustrates a cross-sectional view of the upper chord 20 in which the web receiving portion 60 extends from the flange portion 64 and is in contact with the web 16. Inner flange portions 62 extend from the web receiving portion 60. In a preferred embodiment of the present invention, web receiving portion 60 comprises two web receiving tabs, and flange portion 64 comprises a lower bearing portion 68 and an upper bearing extension 66.

In operation, chord members and the web typically experience varying loads along their lengths. Accordingly, it is advantageous to provide a means of stiffening the chords and web by affixing segments thereto.

Figure 15:
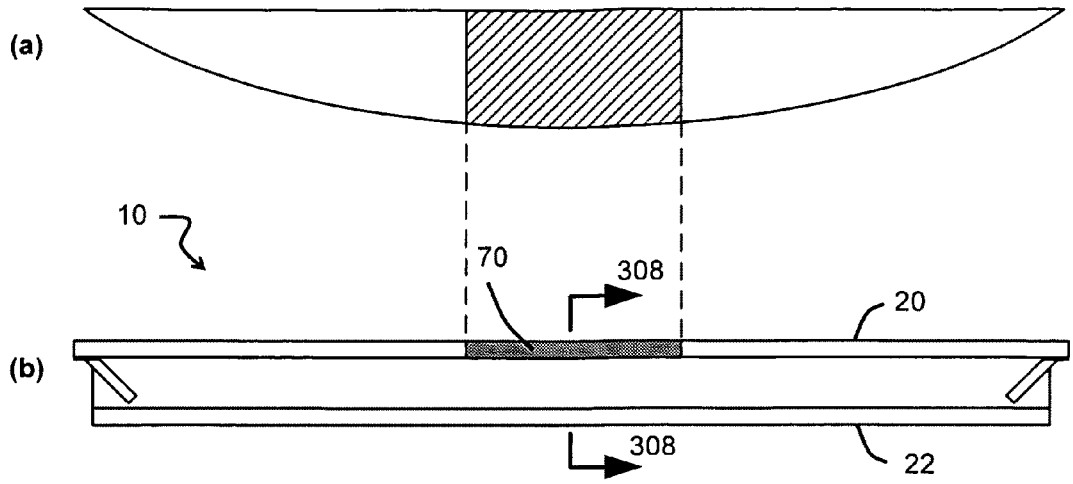
FIG. 15 shows a moment diagram (a) of a joist (b)
Figure 16:
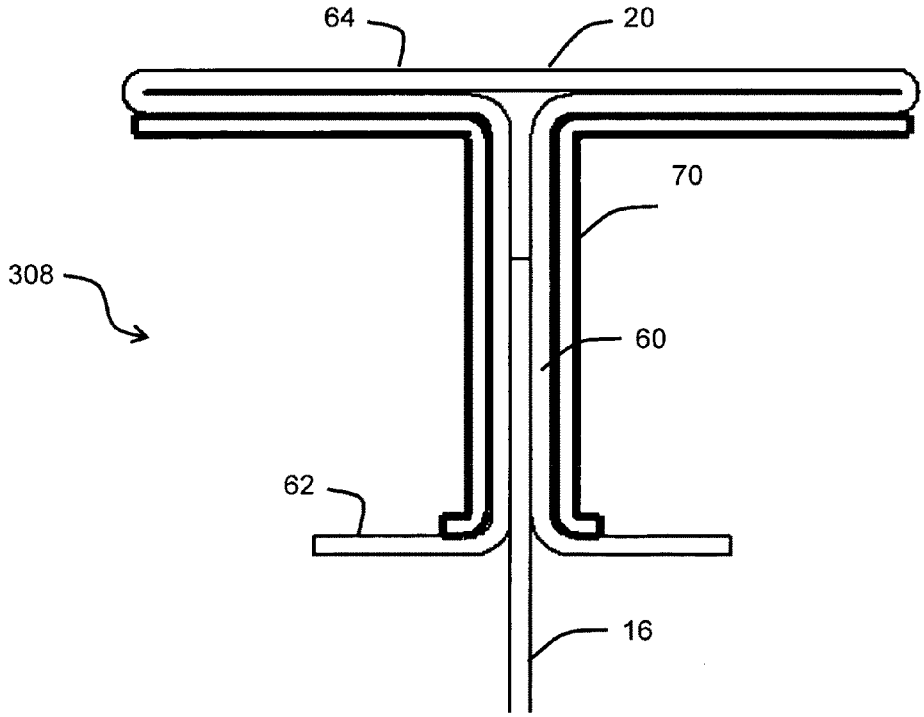
FIG. 16 shows a cross-section of the middle of the joist of FIG. 15(*b*)

FIG. 15(*a*) shows a moment diagram illustrating the magnitude of bending stress on the joist. FIG. 15(*b*) shows a corresponding joist with a segmented chord reinforcement 70 installed along the top chord 20. FIG. 16 shows a cross-section of section 308 and the segmented chord reinforcement 70. The segmented reinforcements may be fastened by welding, riveting, clinching, bolting, or any other fastening method.

While in situ, the top chord 20 resists compressive forces while the bottom chord 22 resists tensile forces resulting from bending of the joist member 10. Often, there are one or more regions within the length of the joist that experiences larger bending stresses, the compressive and tensile stresses in the chord member are the greatest within these regions. To increase the efficiency of material use, a continuous top or bottom chord may be provided for the entire length of the joist such that the flexural resistance of the joist 10 is sufficiently larger then the regions of lowest bending stresses. A chord segment may then be fastened to the regions of higher bending stresses such that the reinforcement functions compositely with the joist, resulting in an increased flexural resistance. Accordingly, the quantity of material used is roughly proportional to the stresses experienced while in situ. As a result of local buckling of thin elements under compression, which reduces material efficiencies, chord reinforcement segmenting is often only required on the chord that resists compressive stresses (top chord 20). However, chord segmenting may also be applied to the tensile resisting chord (bottom chord 22) in order to increase flexural resistance of the section.

Using prior art methods, an extensive procedure must be followed when a sloped joist is required. Coordination between the building parties must be conducted and drawings and specifications must be created in order to accommodate a sloped joist condition. Shoes are generally installed in the shop, where workers perform the necessary layout and welding. Present methods of installing sloped shoes do not allow for any tolerance, and therefore extensive field repairs may be required when the designed slope, as governed by the distance between the supports and difference in elevation of the supports, varies from the as-built support conditions.

Figure 17:
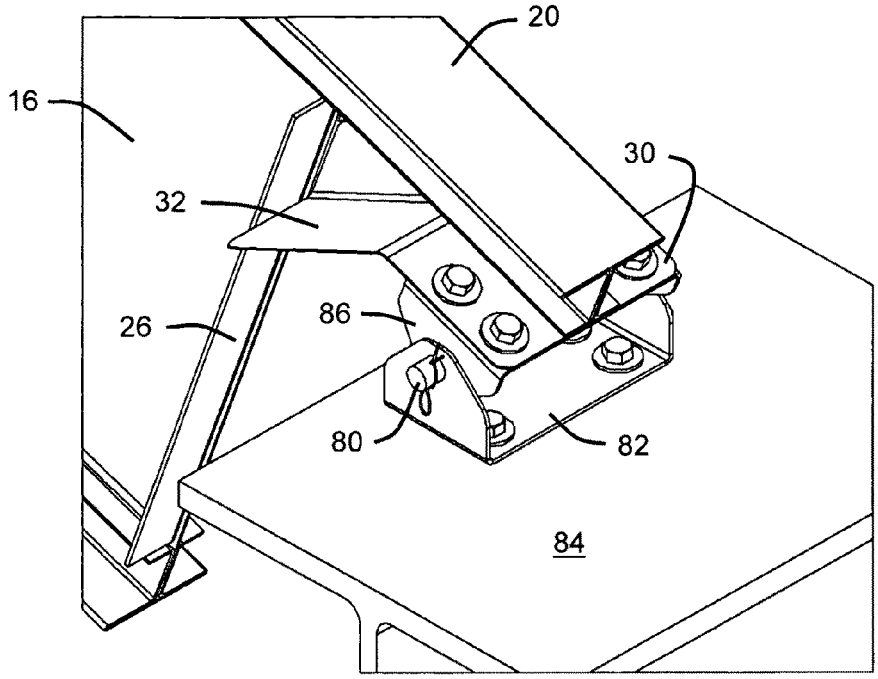
FIG. 17 shows a sloping shoe wherein a joist is connected at an angle to a surrounding structure.
Figure 18:
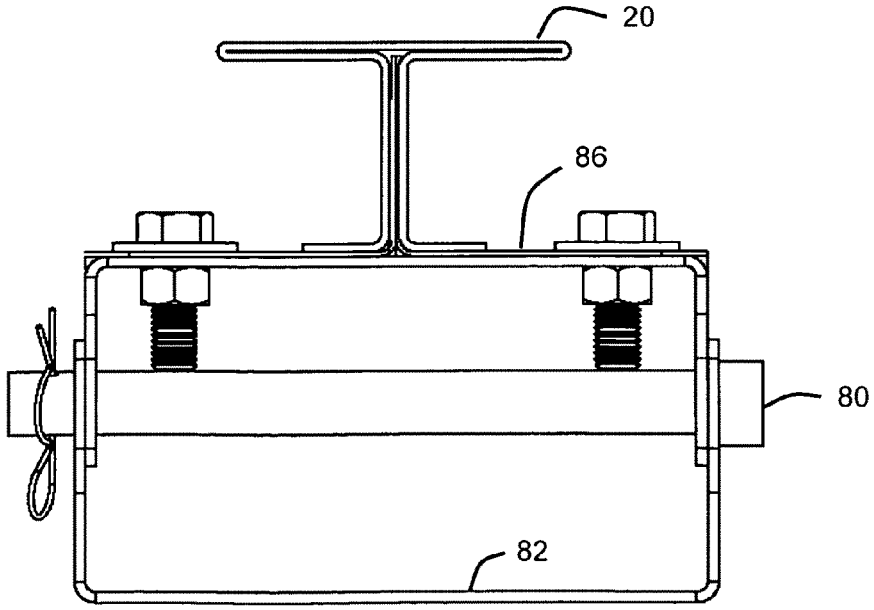
FIG. 18 shows a cross-section of FIG. 17.

Accordingly, it is an aspect of the present invention to provide one standardized sloping shoe that can accommodate a wide range of angles via rotatable pin joint. Referring to FIG. 17, rotatable shoe 86 may be attached to diagonal members 30 and 32. A pin 80 connects rotatable shoe 86 to mount 82 such that the joist is fixed translationally but has one degree of rotational freedom. Mount 82 may be fastened to a surrounding structure 84. FIG. 18 shows a cross-sectional view of the rotatable joint of FIG. 17. Non-limiting examples of fasteners include welding, clinching, riveting, bolting.

Compared to prior art methods of supporting an angled joist, the preferred embodiment of the present invention requires very little coordination, and the sloping shoe does not require any project specific drawings and requires no layout in the shop to determine joist angle. The sloping shoe may rotate about the pin and therefore may accommodate any slope that is expected in the field, regardless of as-built variances in slope requirements. The holes in the sloping shoe are aligned with the holes in the joists shoe; therefore installation may be performed by typical bolting procedures. The rotational degree of freedom introduced by the pin may be eliminated, if so desired, by field welding of the components connected by the pin.

Figure 19:
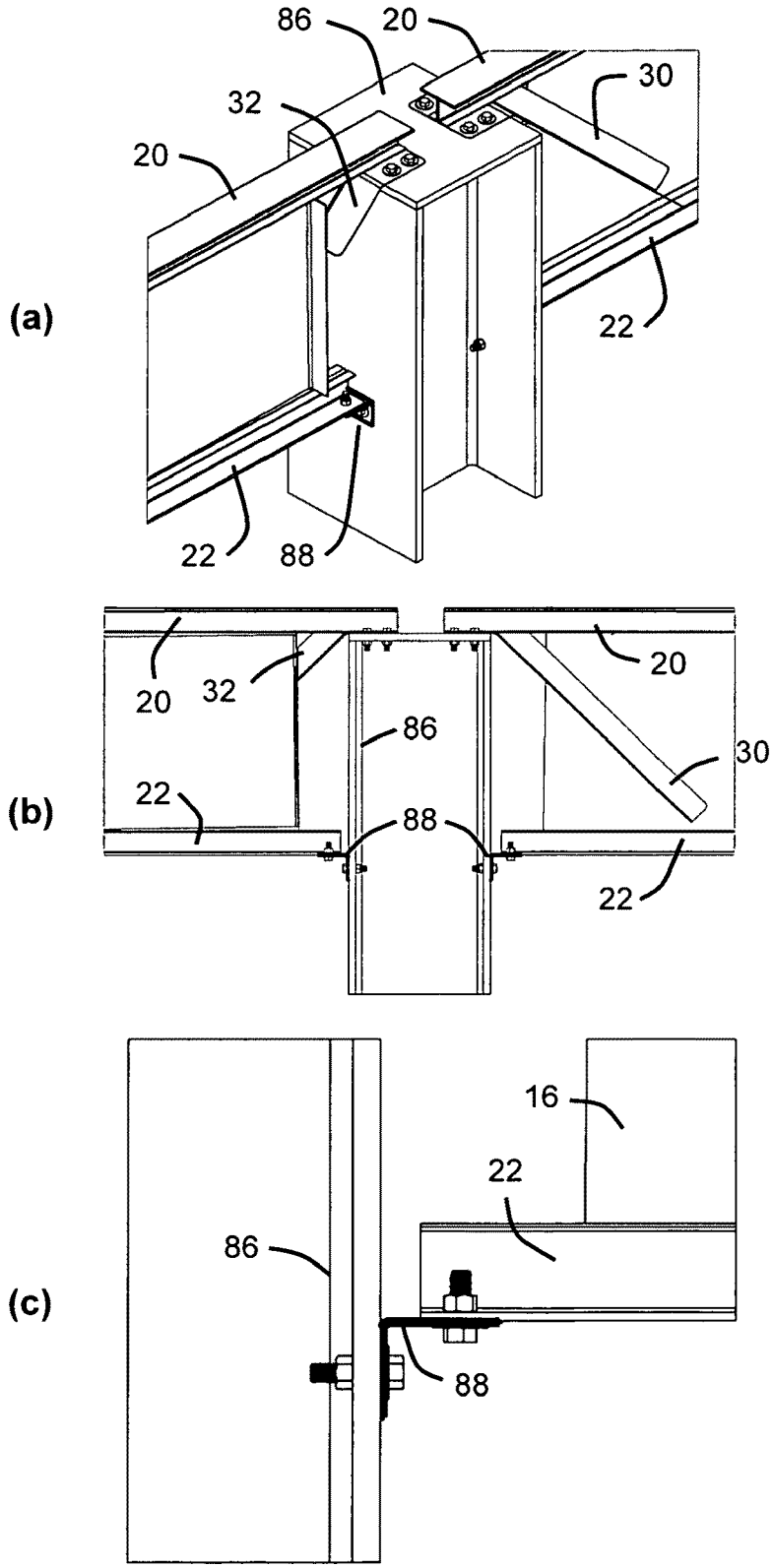
FIG. 19 shows an isometric view (a), side view (b), and close-up side view (c) of a steel joist fastened to a surrounding structure.

In a further aspect of the present invention, one may effectively extend the bottom chord 22 by fastening it to an adjacent column. Referring to FIG. 19, one may fasten the bottom chord 22 to a column 86 or other surrounding structure via a connecting member 88. The top chord 20 is fastened via angled members 30 and 32. The bottom chord or angled members may be fastened to a surrounding structure by welding, clinching, riveting, bolting, or any other fastening means as would be appreciated by a worker skilled in the art.

Some non-limiting examples of motivations for fastening the bottom chord 22 include: (1) provision of lateral restraint of the bottom chord of the joist, (2) stabilization at the top of a column in order to satisfy column design assumptions, (3) torsion stabilization of a girder, and (4) provisions of a moment connection between joist and column.

Figure 20:
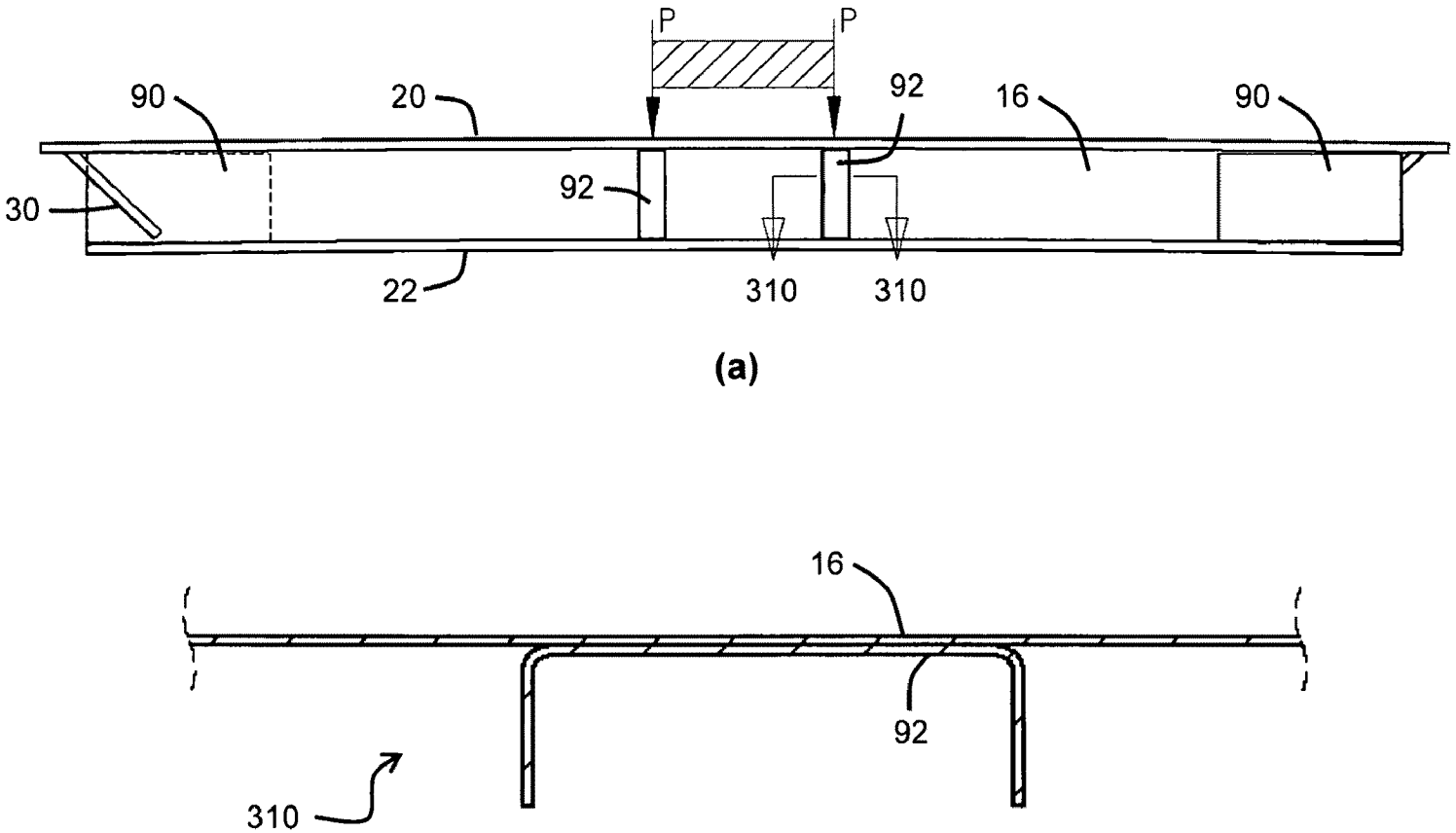
FIG. 20 shows a steel joist with a plurality of reinforcement members.

In use, joists typically face special load conditions, such as concentrated loads P from mechanical units. The preferred embodiment of the present invention accommodates concentrated loads via supplementary stiffeners affixed to the web. Referring to FIG. 20, reinforcement members or stiffeners 92 may be added according to placement of special loads P on the joist system, such as mechanical units or HVAC systems. Stiffeners 92 help prevent local buckling of the web due to concentrated local stresses. For a centrally loaded joist, shear forces are highest at the opposing ends. Accordingly, stiffeners 90 may be added to the ends of the web to counteract shear forces near the ends of the joist.

Figure 21:
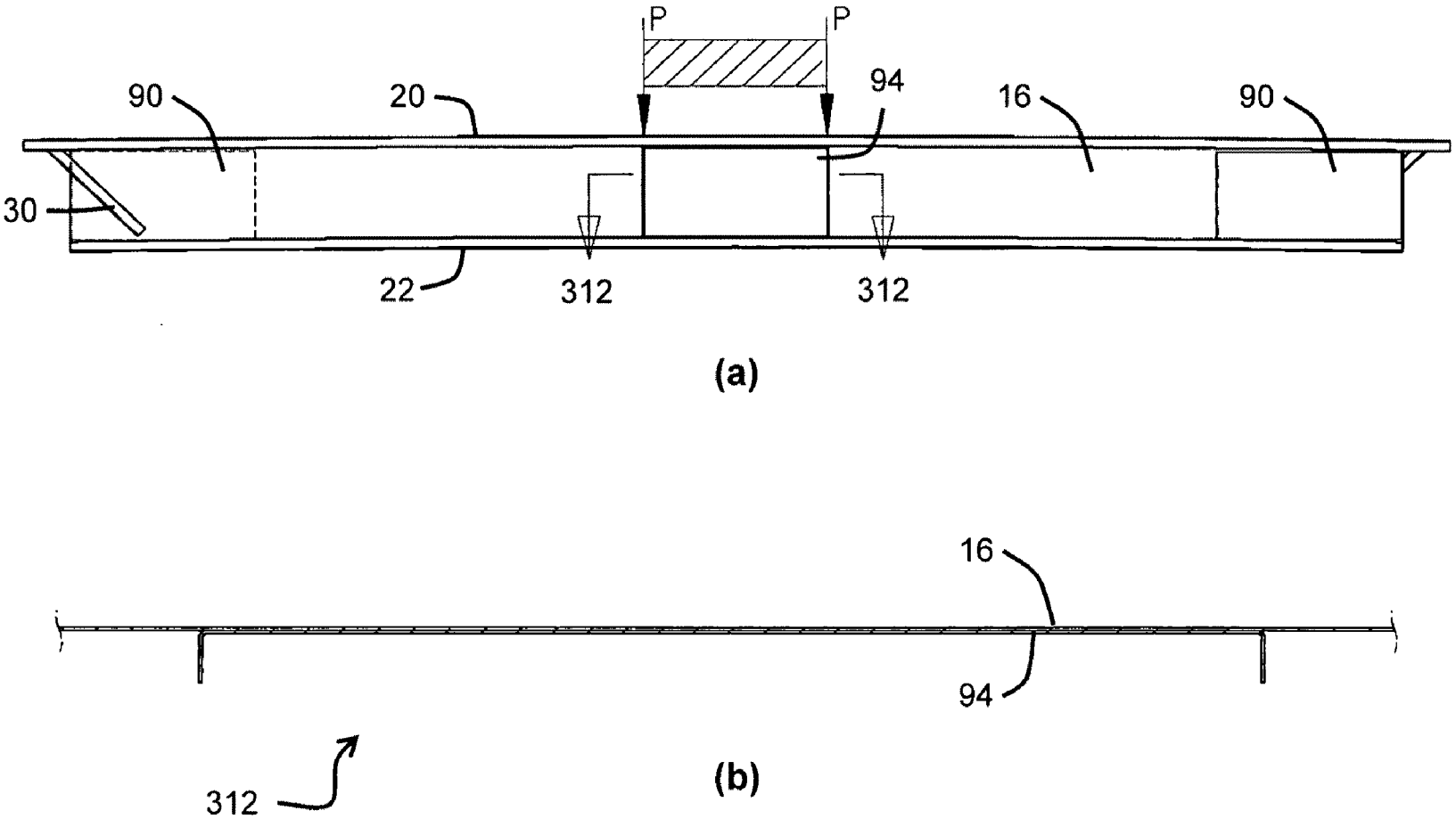
FIG. 21 shows a steel joist with one reinforcement member.

In production, standardized stiffeners may be fabricated that have standardized design values, allowing for expedited accommodation of concentrated loads where the strength of the web 16 alone cannot support the bearing stress. With current top chord bearing joists, once fabricated, a concentrated load can only be installed at a specified location. This invention allows for greater flexibility in accommodating design changes after the joists have already been fabricated and erected. Provided that the flexural capacity and the shear capacity are sufficient, a concentrated load may be repositioned or added anywhere along the length a joist member and reinforced using stiffeners 92. FIG. 20(*b*) shows a cross-sectional view of section 310. The stiffeners 92 may be fabricated from flat coil material with bent lips for added rigidity. FIG. 21 shows a stiffener 94 of larger cross-sectional area. FIG. 21(*b*) shows a cross-sectional view of section 312. The stiffeners or U-shaped reinforcing struts may be fastened by welding, clinching, riveting, bolting, or any other fastening means as would be appreciated by a worker skilled in the art.

Figure 22:
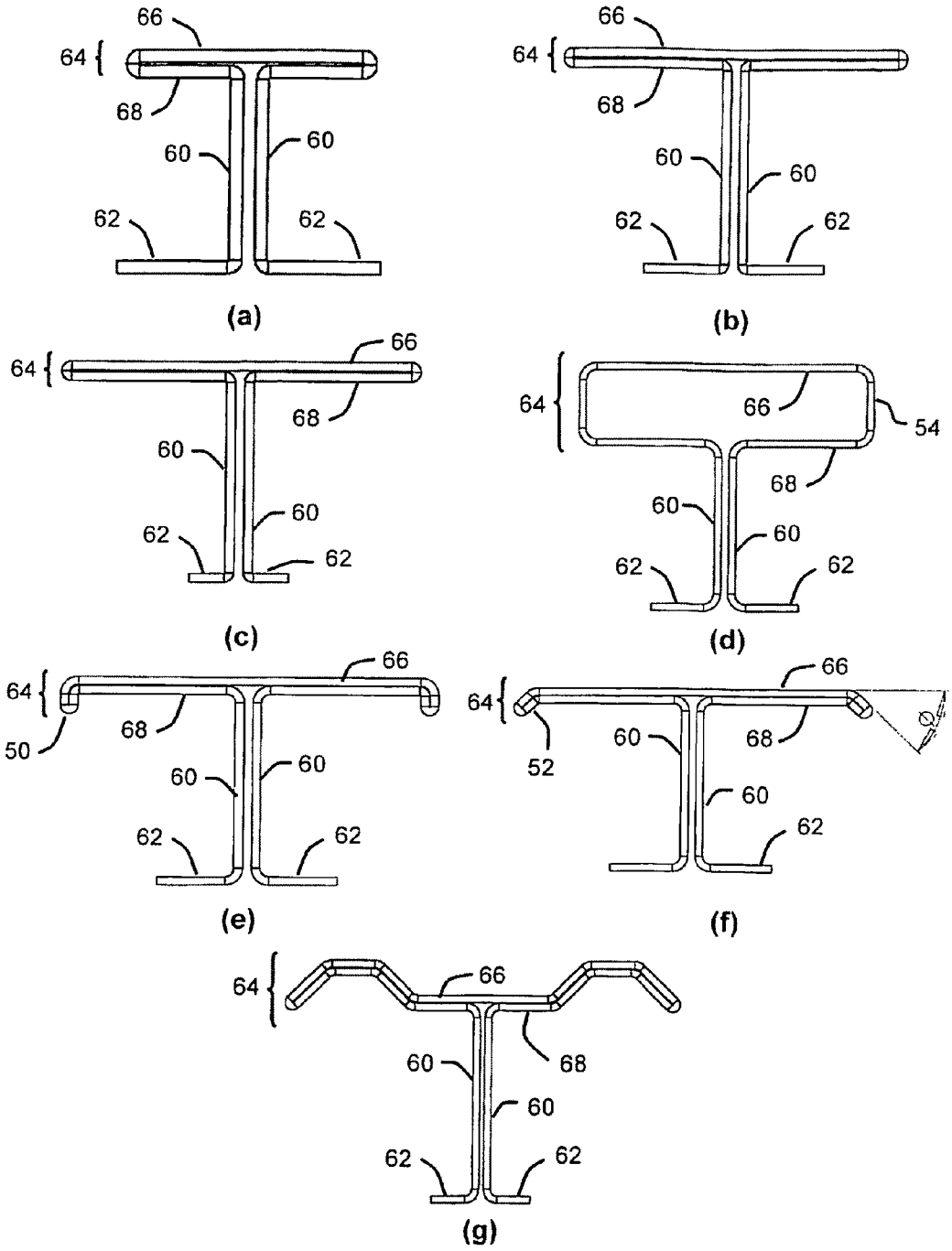
FIGS. 22 (*a*) through (*g*) show cross-sections of possible top-chord members for use with steel cold-formed joists.

While the preferred embodiment the present invention is shown in FIG. 14, it is important to note that other dimensions and arrangements will work depending on the structural requirements of the joist system. FIG. 22 illustrates a number of non-limiting examples of the top chord of the present invention. The chord dimensions may be varied in order to accommodate the requirements of a particular application.

For instance, a larger flange 64 provides increased flexural capacity and structural efficiency (i.e. higher strength to mass ratio) as a result of distributing the material to the outermost regions of the cross section thereby increasing the second moment of area and increasing resistance to bending.

A larger web receiving portion 60 accommodates the camber requirements by providing an increased fastening surface area for the chord to web connection. As per the camber illustrated in FIG. 13 and FIG. 14, the contact between the web and the web receiving portion 60 varies along the web. In a preferred embodiment of the present invention, the web receiving portion 60 is adequately sized such that the minimum amount of contact area 306 and 304 is large enough to fasten the web 16 to flanges 20 and 22.

FIG. 22(*a*) illustrates an embodiment with larger inner flange portions 62, (b) has a larger web receiving portion 60, (c) has a smaller reinforcement lip 62, (d) has a boxed top flange 64 with side portions 54, (e) has turned down edges 50, (f) has partially turned down edges 52, and (g) has a top flange 64 with a plurality of bends.

Regarding FIG. 22(*e*) and FIG. 22(*f*), local buckling resistance can be increased by providing turned down edges 52, and in turn the strength and structural efficiency of the section can be increased. The turned down edges provides support and restraint at the edges of the flange, reducing or eliminating local buckling transference between top and bottom flange elements. The closer the angle Ø of the turned down edge 52 is to 90° (as in turned down edge 50), the greater restraint that is provided and therefore the greatest increase will be realized in strength and efficiency of the cross section. Furthermore, the addition of the turned down edge provides 52 more material to the sides of the cross section, increasing the section's transverse stiffness and therefore increasing the section's lateral stability.

Regarding FIG. 22(*d*), prior art open web steel joists (OWSJ) are generally laterally unstable until deck and bridging are provided. The weakness in the weak axis of the OWSJ section results in a significant amount of work to install bridging and correct sweep in these situations. Accordingly, an embodiment of the present invention includes an upper chord 20 having a flange portion 64 having a box cross-section (FIG. 22(*d*)). The lower bearing portion 68 and upper bearing extension 66 are connected via side portion 54. The box-shaped cross-section of flange portion 64 increases the lateral stability and weak axis stiffness of the joist's cross section. By distributing material to the side portion 53 of the section, the weak axis stiffness of the section increases, resulting in less sweep during construction and therefore easier installation. Furthermore, increasing the weak axis stiffness provides for increase resistance against lateral torsional buckling, reducing the amount of bridging required in a floor or roof system. Referring to FIG. 22(*g*), flange portion 64 introduces a number of bends to prevent local buckling and increase the second moment of area and resistance to bending.

Figure 23:
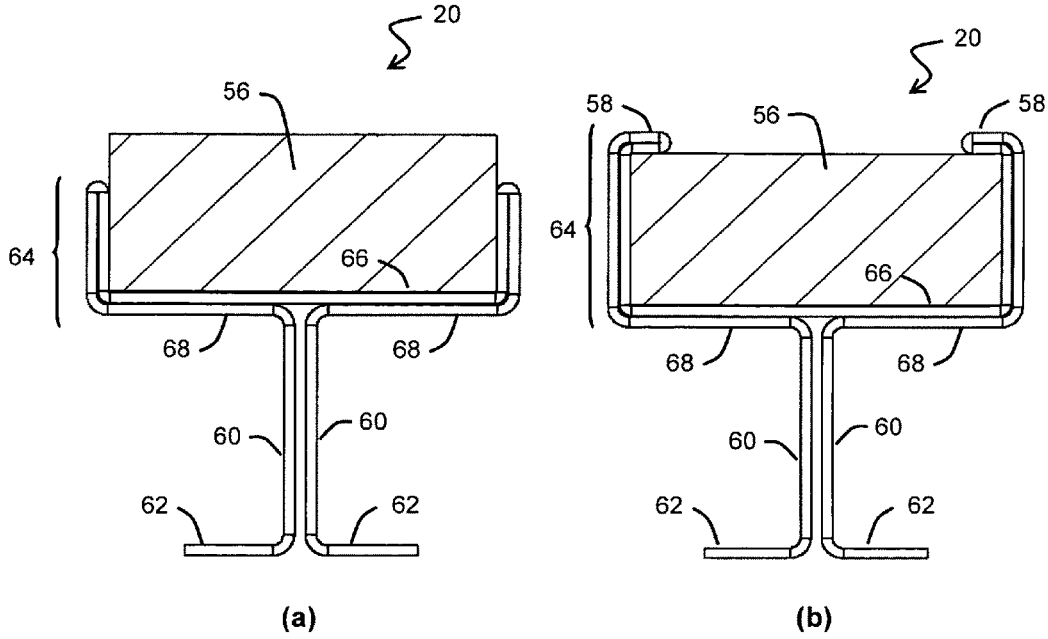
FIGS. 23 (*a*) and (*b*) show a cross-section view of a joist fastened to wood with two configurations.
Figure 24:
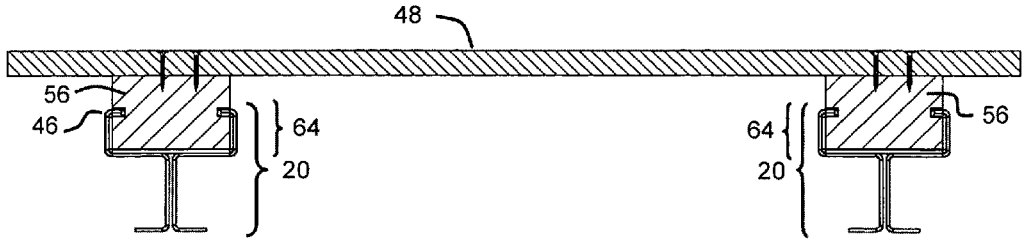
FIG. 24 shows a cross-section view of a plurality of joists fastened to wood and nailed to a floor plank.

In markets where designers are concerned with seismic conditions and wish to use plywood decking to provide a horizontal diaphragm, it is common for the market to desire roof joists that have a continuous block of wood fastened to its top chord. FIG. 23 shows a cross-sectional view of a top chord 20 with a block of wood 56 fastened thereto. The remaining components of the joist, such as the web, are not shown. The block of wood is in contact with upper bearing extension 66. FIG. 23(*b*) shows a possible means of attaching the block of wood whereby edges 58 are folded over the block of wood 56 to hold it in place. FIG. 24 shows a plurality of top chords 20 with blocks of wood 56. In FIG. 24, turned edges 46 of the top chord interlock with grooves formed along a length of the blocks of wood 56. Plywood may be fastened atop the blocks of wood 56 with nails or screws. The combination of wood and steel provides strong resistance to seismic conditions.

Figure 25:
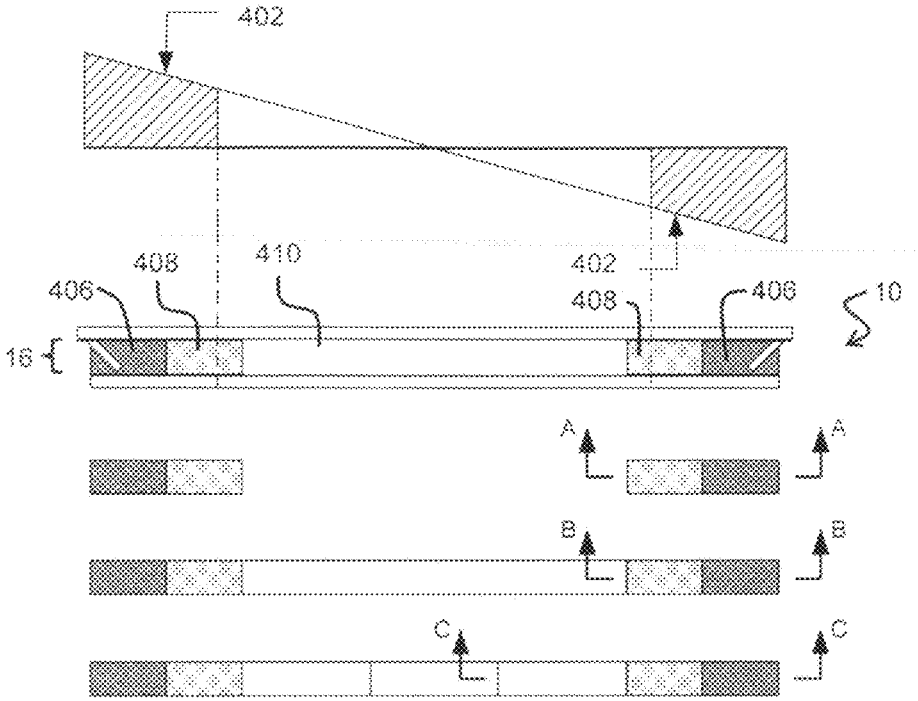
FIG. 25 shows a schematic representation of alternate embodiments of a joist having a web made of a plurality of web segments.
Figure 26:
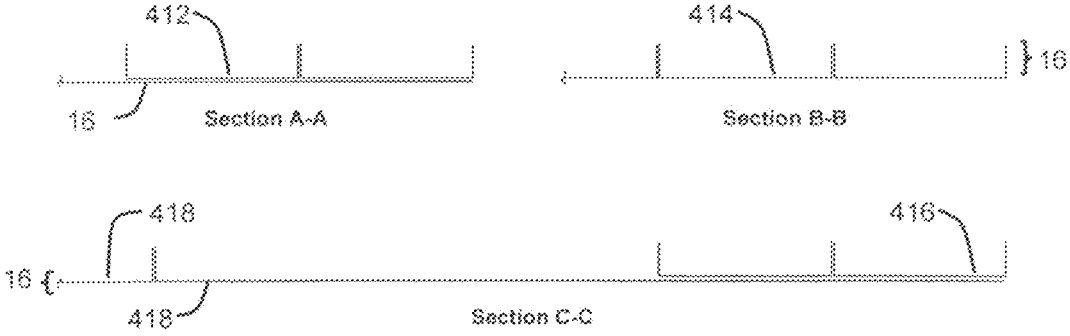
FIG. 26 shows cross-sectional views of the alternate embodiments of different sections of the joist shown in FIG. 25.

To strengthen the web 16 of joist 10, stiffeners may be added as in FIG. 21, or alternatively the web may be made of a plurality of pieces joined together as in FIG. 25 and FIG. 26. Referring to FIG. 25, zone 402 represents the area of highest stress. Accordingly, joist 10 may have a web 16 that comprises a plurality of web segments which vary in thickness as a function of shear stress. Segment 406 is connected to and is thicker than segment 408 which is connected to and thicker than segment 410. The purpose of these segments is to provide a means to vary material thicknesses to satisfy the varying loads occurring along the length of the web of a joist 10. The ability to provide alternative material thicknesses allows for the efficient use of material while maintaining the required web shear resistance or bearing resistance. Thicker web segments can be used in areas of high shear stress, while thinner material can be used where the shear stresses are lower.

Referring to FIG. 26, stiffeners 412 may be fastened to web 16 (Section A-A); or web 16 may be a plurality of web segments 414 that in combination form web 16 (Section B-B); or the web may be a plurality of web segments 418 that in combination form web 16 with additional stiffeners 416 attached to web 16 (Section C-C). FIG. 26 illustrates the principle that one may achieve variable web thickness in more than one way. Web segments may be thickened in the form of a single thickness (Section B-B) or the combined thickness of a web segment and a backer web (Section C-C). Furthermore, when low to mid level concentrated loads are known prior to design of the joist, web segments may be provided in these areas in order to support the increased bearing resistance requirements. The web segments are fastened to one another and are adapted to receive fasteners such as rivets, nuts and bolts, or may receive spot clinches to secure the plurality of web segments.

As used herein, the terms "comprises", "comprising", "includes" and "including" are to be construed as being inclusive and open ended, and not exclusive. Specifically, when used in this specification including claims, the terms "comprises", "comprising", "includes" and "including" and variations thereof mean the specified features, steps or components are included. These terms are not to be interpreted to exclude the presence of other features, steps or components.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

Therefore what is claimed is:

1. An upper chord bearing joist comprising:

a top chord member being cold-formed from a unitary piece of sheet steel and having: a flange portion, a web receiving portion including two web receiving tabs, and a pair of integral inner flange portions, each inner flange portion extending substantially perpendicularly from one of the web receiving tabs so as to be in a spaced relationship to the flange portion;

a bottom chord member being cold-formed from a unitary piece of sheet steel and having a flange portion and a web receiving portion including two web receiving tabs; and a generally planar solid steel web, a portion of the web being attached to the top chord member and to the bottom chord member, wherein a top portion of the web is between the two web receiving tabs of the top chord member and a bottom portion of the web is between the two web receiving tabs of the bottom chord member, said top portion defining a top surface area of contact, and said bottom portion defining a bottom surface area of contact, the generally planar solid steel web having a top surface and a bottom surface;

wherein the top surface and bottom surface of the web extend substantially straight, and each chord member is cambered about the web such that the top and bottom surface area of contact varies along a length of the joist.

2. The upper chord bearing joist of claim 1 wherein the top surface area of contact in a center of the joist is less than the top surface area of contact in the first and second end of the joist.

3. The upper chord bearing joist of claim 1 wherein the generally planar steel web is a generally elongate planar rectangular sheet of steel metal.

4. The upper chord bearing joist of claim 3 wherein the generally planar steel web has a stiffening extension extending from one of: a first end of the web, a second end of the web, and both a first end of the web and a second end of the web.

5. An upper chord bearing joist comprising:

a top chord member and a bottom chord member, each having a flange portion and a web receiving portion including two web receiving tabs, each made from a unitary piece of metal;

a generally planar solid steel web, a portion of the web being attached to the top chord member and to the bottom chord member, wherein a top portion of the web is between the two web receiving tabs of the top chord member and a bottom portion of the web is between the two web receiving tabs of the bottom chord member, and the generally planar solid steel web has a front planar face, a back planar face, a top surface and a bottom surface;

a first and second pair of support members, each support member including a shoe portion, a web attaching portion, and an angled portion, the web attaching portion being attached to one of the front planar face and the back planar face of the generally planar solid steel web, whereby the first pair of support members is attached to a first end of the joist and the second support member is attached to a second end of the joist; and wherein the top surface and bottom surface of the web extend substantially straight, and each chord member is cambered about the web such that the surface area of contact varies along a length of the joist.

6. The upper chord bearing joist of claim 5 further including at least one reinforcement member attached to one of: the top chord member, the bottom chord member, and the web.

7. The upper chord bearing joist of claim 5 wherein the flange portion of the top chord comprises an upper bearing portion integrally formed with at least one lower bearing extension to produce a rigid member, the upper bearing portion being in a spaced relationship from the at least one lower bearing extension.

8. The upper chord bearing joist of claim 5 wherein the flange portion of the top chord is substantially rectangular in cross-section.

9. The upper chord bearing joist of claim 5, wherein the flange portion of the top chord member has an upper bearing portion integrally formed with at least one lower bearing extension to produce a rigid member, the upper bearing portion being folded over the least one lower bearing extension.

10. The upper chord bearing joist of claim 9 wherein the rigid member has at least one bend along its length.

11. The upper chord bearing joist of claim 10 wherein the at least one bend is at least two trough-shaped bends.

12. The upper chord bearing joist of claim 9 wherein the rigid member has a first and second edge opposite from one another, and wherein the first and second edge are each bent to form a first and second bent portion.

13. The upper chord bearing joist of claim 9 wherein each bent portion is substantially perpendicular to a remaining portion of the rigid member.

14. The upper chord bearing joist of claim 5 wherein the flange portion of the top chord supports an elongate wooden member along the length of the top chord member.

15. The upper chord bearing joist of claim 14 wherein the flange portion of the top chord member contacts at least a bottom surface, a left surface, and a right surface opposite the left surface, of the elongate wooden member.

16. The upper chord bearing joist of claim 14 wherein the flange portion of the top chord member contacts a substantial portion of the bottom surface, left surface, and right surface of the elongate wooden member.

17. The upper chord bearing joist of claim 14 wherein the elongate wooden member has at least one groove along the length of the wooden member, and wherein the flange portion of the top chord member has a portion inserted into said at least one groove.

* * * * *